US006889913B2

(12) United States Patent
Ruehle et al.

(10) Patent No.: US 6,889,913 B2
(45) Date of Patent: May 10, 2005

(54) FUEL INJECTOR

(75) Inventors: Wolfgang Ruehle, Ditzingen (DE); Hubert Stier, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 155 days.

(21) Appl. No.: 10/194,693

(22) Filed: Jul. 12, 2002

(65) Prior Publication Data

US 2003/0015601 A1 Jan. 23, 2003

Related U.S. Application Data

(62) Division of application No. 09/701,097, filed on Apr. 6, 2001, now Pat. No. 6,435,430.

(30) Foreign Application Priority Data

Mar. 20, 1999 (DE) ..... 199 12 666

(51) Int. Cl.[7] ..... B05B 1/08; B05B 1/30

(52) U.S. Cl. ..... 239/102.2; 239/102.1; 239/585.1; 239/585.3; 239/585.5; 239/533.3

(58) Field of Search ..... 239/102.2, 102.1, 239/585.1, 585.2, 585.3, 585.4, 585.5, 533.2, 533.3, 533.13, 88–92; 251/129.06, 129.21, 129.15

(56) References Cited

U.S. PATENT DOCUMENTS

| | | | | |
|---|---|---|---|---|
| 4,553,059 A | | 11/1985 | Sakakibara et al. | |
| 4,803,393 A | | 2/1989 | Takahashi | |
| 4,814,659 A | | 3/1989 | Sawada | |
| 5,035,637 A | * | 7/1991 | Mathews et al. | 439/271 |
| 5,979,803 A | | 11/1999 | Peters et al. | |
| 6,234,404 B1 | | 5/2001 | Cooke | |
| 6,299,074 B1 | | 10/2001 | Cooke | |
| 6,435,430 B1 | * | 8/2002 | Ruehle et al. | 239/585.4 |

FOREIGN PATENT DOCUMENTS

| | | |
|---|---|---|
| DE | 195 34 445 | 3/1997 |
| DE | 196 50 900 | 6/1998 |
| DE | 196 53 555 | 6/1998 |
| EP | 1115975 | 3/2000 |
| EP | 0 995 901 | 4/2000 |
| EP | 1045973 | 5/2000 |
| GB | 2 094 940 | 9/1982 |
| JP | 63-223361 | 9/1988 |
| JP | 2-112663 | 4/1990 |

* cited by examiner

*Primary Examiner*—Davis Hwu
(74) *Attorney, Agent, or Firm*—Kenyon & Kenyon

(57) ABSTRACT

A fuel injector for a fuel injection system of an internal combustion engine is described. The fuel injector has a fuel inlet connection piece for supplying fuel, a piezoelectric or magnetostrictive actuator, which is sealed off from the fuel by a seal, and a valve closing body actuatable by the actuator via a valve needle. The valve closing body working together with a valve seat surface to form a seal seat. The seal includes an inlet-side gasket, which is arranged between the fuel inlet connection piece and the actuator, and an actuator jacket that is elastically deformable in a longitudinal direction and is connected to the inlet-side gasket.

3 Claims, 3 Drawing Sheets

FUEL INJECTOR

CROSS-REFERENCE TO RELATED APPLICATIONS

This application is a division of prior application Ser. No. 09/701,097, filed Apr. 6, 2001, now U.S. Pat. No. 6,435,430.

FIELD OF THE INVENTION

The present invention relates to a fuel injector.

BACKGROUND INFORMATION

German Patent No. 195 34 445 describes a fuel injector. The fuel injector described in this document has a valve body in which a valve needle is coaxially guided. The valve body has a connection piece through which fuel is supplied to the fuel injector. The valve needle is provided with a central borehole. On the injection side the valve needle forms a seal seat with the valve body. The fuel is supplied to the seal seat via the central borehole of the valve needle. On the outside the valve needle is sealed with respect to the surrounding valve body. A piezoelectric actuator acts upon the valve needle via a pressure shoulder. The pressure shoulder is permanently connected to the valve needle and is tightly guided on the valve body on the inlet side. This protects the actuator against the effect of the fuel pressure. The conventional fuel injector has the following disadvantages:

Because the valve needle is permanently connected to the pressure shoulder, the valve needle on the injection side and the pressure shoulder on the inlet side are sealingly and movably guided in the valve body therefore, manufacturing is relatively complicated and the valve needle of the fuel injector is subject to bending and stresses and the relative positions of the two sliding surfaces are subject to modification.

Because the pressure shoulder, i.e., the valve needle is movably guided with respect to the valve body, the sealing surface is wetted with fuel and, due to the high fuel pressure, the fuel may flow toward the actuator. Thus the actuator is only protected against the effect of the fuel pressure but not against the effect of the fuel. Due to the seal between the pressure shoulder, i.e., the valve needle and valve body, friction losses occur when the fuel injector is actuated. This negatively affects the shapability of the fuel jet. Further, the switching times of the injector are increased, the actuator power is less efficiently utilized, and fuel injector wear is increased. In particular, the seal at the sealing surfaces between the pressure shoulder, i.e., the valve needle and the valve body deteriorates during operation.

Since the central borehole in the valve needle is a part of a fuel line extending from the fuel inlet connection piece to the seal seat, the manufacture of the valve needle is complicated and the fuel injector is subject to dirt deposits, in particular on its seal seat-side end.

SUMMARY

The fuel injector according to the present invention has the advantage over conventional fuel injectors of a simple, more cost-effective, low-wear, friction-free and considerably more compact design. Furthermore, the seal is independent of the design of the valve needle and can therefore be integrated into a plurality of fuel injectors.

In addition, the actuator sealed with respect to the fuel in this manner can be integrated using the seal, without major structural changes, both into an inward-opening and an outward-opening fuel injector. In addition, the actuator is protected by the seal both against the effect of the fuel and the effect of the fuel pressure.

The actuator jackets advantageously have an undulated or pleated design. This allows a large actuator stroke in the actuator housing in a compact construction. The actuator is advantageously prestressed by the actuator jacket. Additional components such as, for example, compression springs are not needed. A heat-conducting material, for example, a heat-conducting paste, is advantageously provided between the actuator jacket and the actuator. This allows the energy generated by the actuation of the actuator and dissipated in the actuator to be conducted away from the actuator on the heat-conducting material and to the actuator housing. The heat load on the actuator is thus reduced and the service life of the fuel injector is extended.

The seal advantageously has a tubular sleeve that traverses the cutout of the actuator and is at least partially surrounded by the actuator. Thus, the inside of the tubular sleeve is sealed with respect to the actuator and therefore can be traversed by fuel.

The seal advantageously has a seal seat-side gasket that is connected to the actuator jacket and/or to the sleeve. Thus, the actuator can act upon the devices of the fuel injector and/or be supported by them via the seal seat-side gasket. In addition, the seal seat-side gasket can be designed like the inlet-side gasket which facilitates the manufacture of the seal.

The gaskets advantageously have a pot-shaped design whereby devices of the fuel injector can be accommodated within the gaskets. In addition, the gaskets can thereby be more easily guided in a guide.

Each gasket advantageously has a cutout that is traversed by the sleeve. The sleeve is bent back on at least one gasket and widened, and is connected to the gasket at its end facing away from the respective other gasket, allowing a large actuator stroke in the actuator housing.

At least one of the gaskets advantageously has a pot-shaped design and an end zone of the gasket projects over the bent-back zone of the sleeve, protecting the bent-back zone of the sleeve.

The inlet-side gasket advantageously has at least one supply channel through which at least one electrical lead is run to the actuator, allowing the electrical lead to enter the seal in a simple manner.

The supply channel is advantageously sealed with respect to the fuel, thus integrating the seal of the electrical lead with respect to the fuel into the gasket, making an additional seal is unnecessary and resulting in a more compact design.

The sleeve is advantageously part of a fuel line extending from the fuel inlet connection piece to the seal seat. This simplifies the fuel line in particular for an end-mounted fuel connection piece. In addition, no additional fuel line is needed, resulting in fewer components.

DETAILED DESCRIPTION

Figure 1:
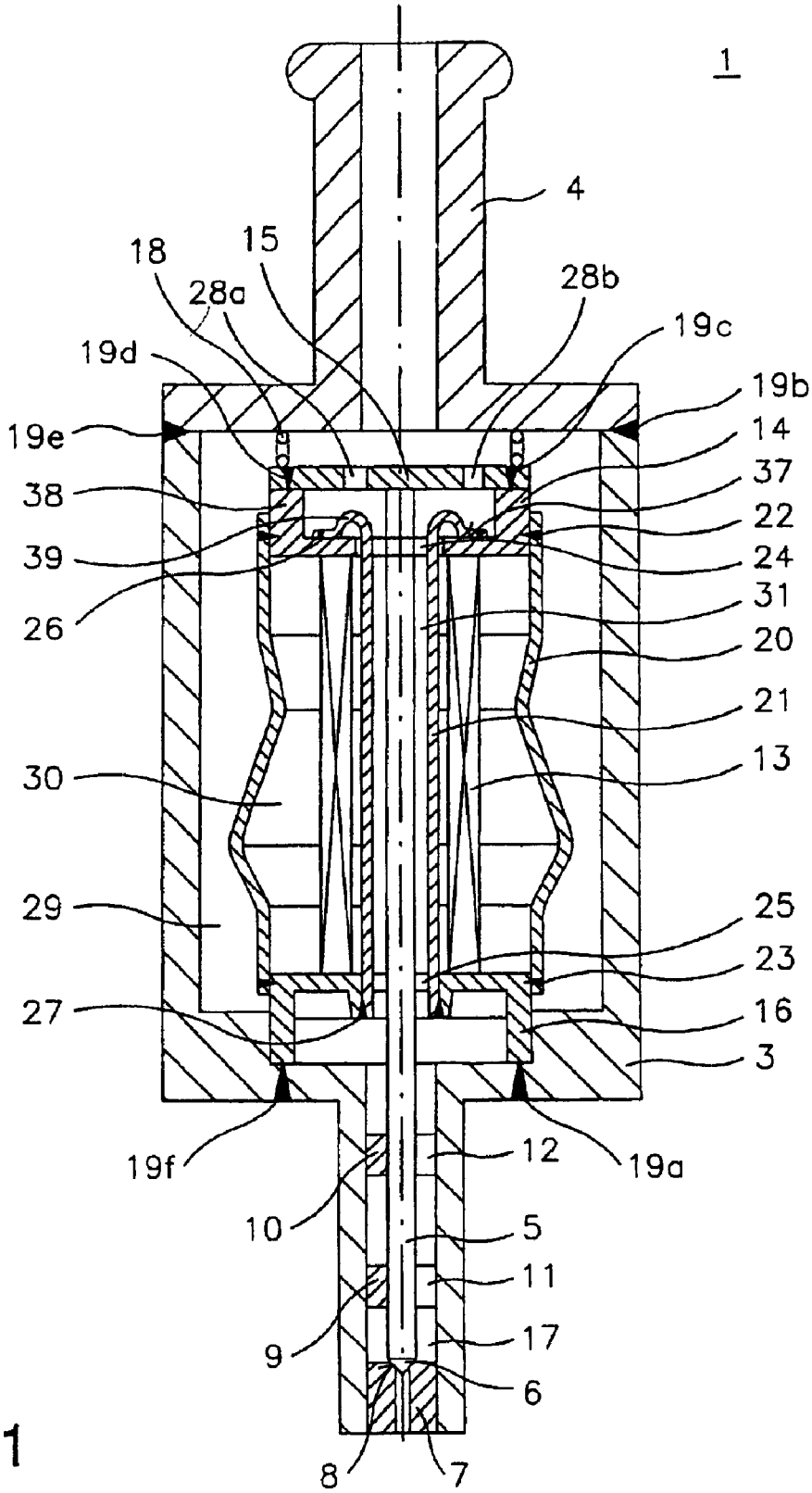
FIG. 1 shows a partial axial through section of a first embodiment of a fuel injector that has an inward-opening design according to the present invention.

FIG. 1 shows in a partial axial section a fuel injector 1 according to the present invention. Fuel injector 1 is used for direct injection of fuel, for example of gasoline, into a combustion chamber of a compressed mixture, externally ignited internal combustion engine as a "direct gasoline injector." Fuel injector 1 according to the present invention is also suitable for other applications.

Fuel injector 1 is designed as an inward-opening fuel injector 1. Fuel injector 1 has a valve housing 3 and a fuel inlet connection piece 4, representing the fuel inlet, which together form the housing of fuel injector 1. A valve closing body 6, which in the embodiment illustrated is designed in one piece with a valve needle 5 and which can be actuated by valve needle 5, is located in valve housing 3. Valve closing body 6 has a truncated cone shaped tapering in the direction of injection. Valve closing body 6 works together with a valve seat surface 8 formed on a valve seat body 7 to form a seal seat. Valve needle 5 is guided in its axial movement by valve needle guides 9, 10, which are attached to valve housing 3. In order to allow fuel to flow through, valve needle guides 9, 10 have slot-shaped cutouts 11, 12.

An actuator 13, which has a piezoelectric or magnetostrictive design, is used to actuate fuel injector 1. Actuator 13 is actuated by an electrical control signal supplied to actuator 13 by an electrical lead, which is not shown in this embodiment for the sake of simplicity. When actuator 13 is actuated, it expands and acts upon baseplate 15, to which valve needle 5 is attached, via an inlet-side gasket 14. Actuator 13 is supported by valve housing 3 via a seal seat-side gasket 16. Thus valve needle 5 is moved in the axial direction onto fuel inlet connection piece 4, whereby valve closing body 6 is lifted from valve seat surface 8 of valve seat body 7, exposing the seal seat. Due to the gap formed between valve closing body 6 and valve seat body 7, fuel exits from a fuel chamber 17 of fuel injector 1 into the combustion chamber of the internal combustion engine. Valve needle 5 is reset in this embodiment via a compression spring 18, supported on one side by baseplate 15 and on the other side by fuel inlet connection piece 4.

Valve housing 3, fuel inlet connection piece 4, baseplate 15, inlet-side gasket 14 and seal seat-side gasket 16 are attached to one another via welds 19*a* through 19*f* However, they can also be attached in some other fashion.

An actuator jacket 20 and a sleeve 21 are attached to inlet-side gasket 14 and seal seat-side gasket 16. Actuator jacket 20 is permanently connected to inlet-side gasket 14 by a peripheral weld 22 and to seal seat-side gasket 16 by a peripheral weld 23. The joint may, however, also be of a different kind, including a detachable joint. Inlet-side gasket 14 and seal seat-side gasket 16 have internal cutouts 24, 25, traversed by sleeve 21. Sleeve 21 is widened and bent back on inlet-side gasket 14 in a bent-back zone 39, and is connected to one end face 37 of inlet-side gasket 14 at a peripheral weld 26 and to seal seat-side gasket 16 at a peripheral weld 27. Inlet-side gasket 14 has an end zone 38 at which inlet-side gasket 14 is connected to baseplate 15. Edge zone 38 of inlet-side gasket 14 projects over a bent-back zone 39 of sleeve 21. Sleeve 21 widened and bent back on inlet-side gasket 14 can be moved in the direction of fuel inlet connection piece 4 due to the pot-shaped design of inlet-side gasket 14 as actuator 13 expands, the seal of actuator 13 remaining with respect to the fuel due to seals 14, 16, 20, 21. For the same reason, actuator jacket 20 has an undulated or pleated design. Actuator 13 can be prestressed by actuator jacket 20 so that compression spring 18 is no longer necessary.

Fuel is supplied into a fuel chamber 17 by fuel inlet connection piece 4, through boreholes 28*a*, 28*b* in baseplate 15, and through an internal longitudinal opening 31 in sleeve 21, through which valve needle 5 also extends. Fuel can also be conducted, as an alternative, through internal space 29 of valve housing 3, in which case appropriate through openings are provided in seal seat-side gasket 16.

A heat-conducting material, for example a heat-conducting paste, can be introduced in a gap 30 between actuator jacket 20 and actuator 13, whereby the heat of actuator 13 is conducted to valve housing 3 via heat-conducting paste in gap 30 and via seal seat-side gasket 16. In a similar manner, the space between actuator 13 and sleeve 21 can also be filled with a heat-conducting paste in order to transmit heat to the fuel.

Figure 2:
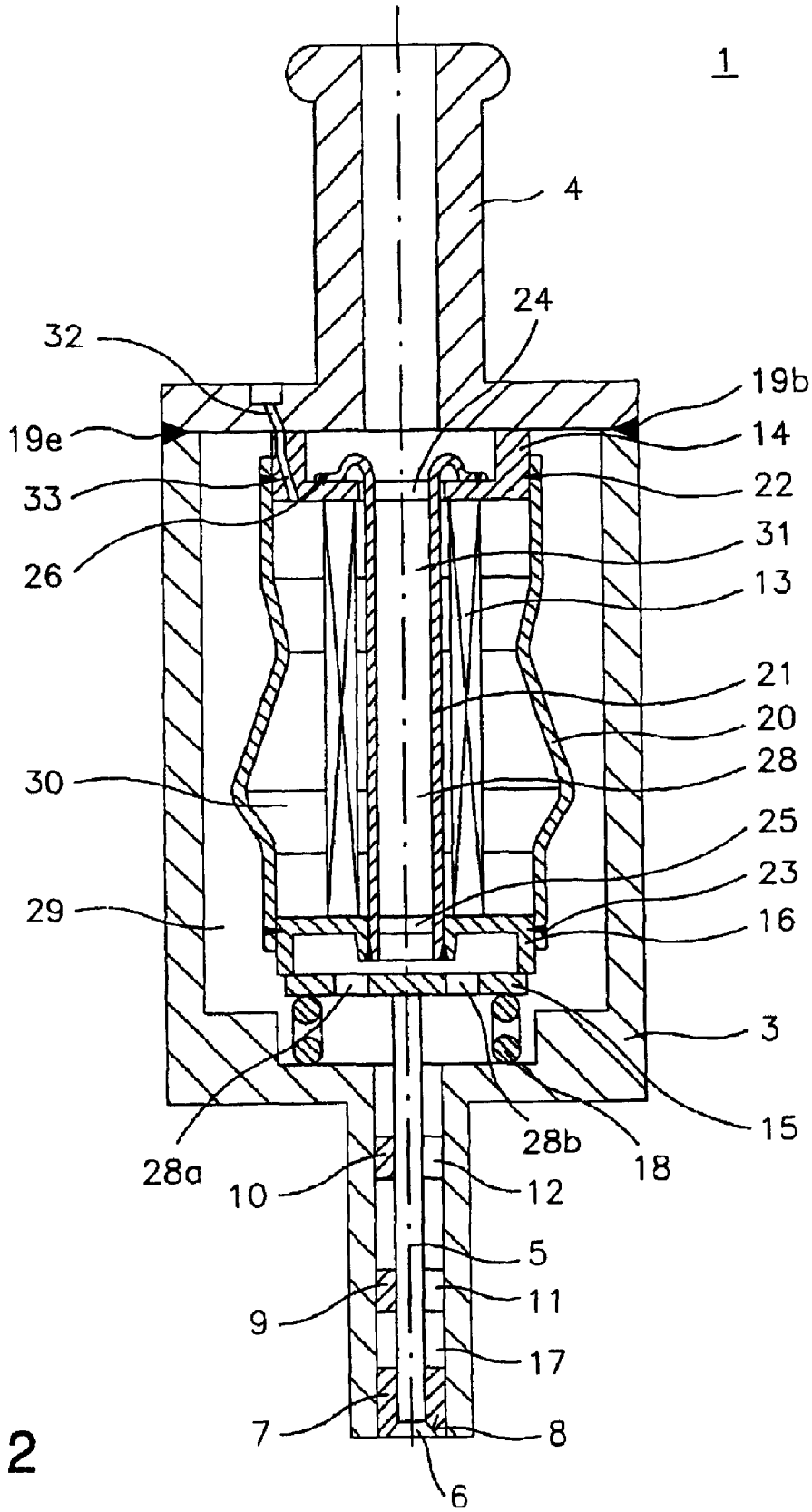
FIG. 2 shows a partial axial through section of a second embodiment of a fuel injector that has an outward-opening design according to the present invention.

FIG. 2 shows in a partial axial section of a second embodiment of fuel injector 1 according to the present invention. Elements described previously are provided with the same reference symbols, making repetition of the description unnecessary.

The second embodiment of fuel injector 1 is an outward-opening fuel injector 1. Pot-shaped, inlet-side gasket 14 is supported by fuel inlet connection piece 4, so that when actuator 13 is actuated, the latter expands in the direction of the seal seat and acts upon valve needle 5 via seal seat-side gasket 16 and baseplate 15, whereby truncated cone-shaped valve closing body 6, widening in the direction of injection and designed in one piece with valve needle 5, is lifted from valve seat surface 8 of valve seat body 7 exposing the seal seat. Valve closing body 6 is pressed against valve seat surface 8 of valve seat body 7 via compression spring 18 supported on one side by valve housing 3 and on the other side by baseplate 15. As described with reference to the embodiment illustrated in FIG. 1, the function of compression spring 18 can be assumed fully or in part by actuator jacket 20.

The electrical leads can be run to actuator 13 via supply channels 32 and 33 in fuel inlet connection piece 4, i.e., in gasket 14. Supply channels 32, 33 may also be used for de-aerating seal 14, 16, 20, 21 or to remove leakage fluid from seal 14, 16, 20, 21. Fuel flows toward the seal seat via longitudinal opening 31 and boreholes 28*a*, 28*b* in baseplate 15. As in the embodiment illustrated in FIG. 1, a heat-conducting material, for example a heat-conducting paste, can be introduced in gap 30 between actuator jacket 20 and actuator 13 and/or between sleeve 21 and actuator 13.

Figure 3:
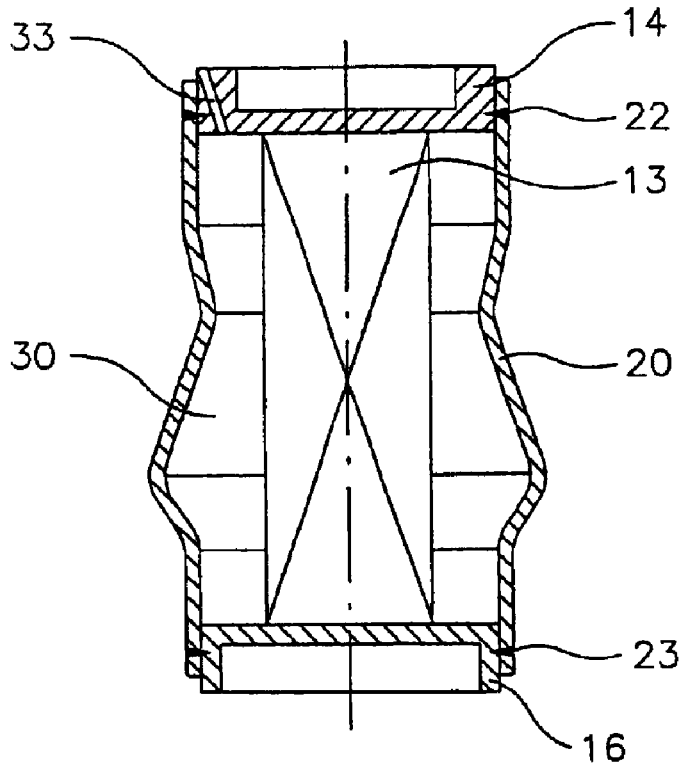
FIG. 3 shows an axial through section of an actuator that has a seal according to the present invention.

FIG. 3 shows in the sectional view a further embodiment of seal 14, 16, 20 of actuator 13. Actuator jacket 20 is welded to inlet-side gasket 14 and seal seat-side gasket 16 via peripheral welds 22 and 23, respectively. Actuator 13 is located between the two pot-shaped gaskets 14, 16. A supply channel 33 for accommodating an electrical lead leading to actuator 13 is provided in inlet-side gasket 14. Supply channel 33 may, however, also be provided in seal seat-side gasket 16. In this embodiment sleeve 21 is not used; therefore actuator 13 is designed without internal longitudinal opening 31. Fuel therefore is supplied outside actuator jacket 20.

Figure 4:
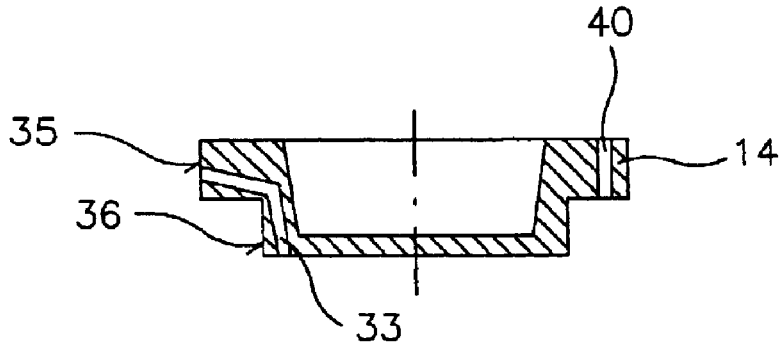
FIG. 4 shows an axial through section of a gasket according to the present invention.

FIG. 4 shows, in a sectional view, a further embodiment of inlet-side gasket 14. In this embodiment, supply channel 33 is designed with a bend, with supply channel 33 opening at peripheral surface 35 of inlet-side gasket 14. Inlet-side gasket 14 can be attached to the internal wall of valve housing 3 via peripheral surface 35, for example by welding. Thus the electrical lead can be run via a terminal provided in valve housing 3 from the side of fuel injector 1 through supply channel 33 to actuator 13. The opening of supply channel 33 at peripheral surface 35 must be sealed with respect to the fuel in order to prevent fuel from entering. A weld running around the opening between peripheral surface 35 and valve housing 3 is particularly well-suited for this purpose. Actuator jacket 20 may be attached to lower peripheral surface 36 of inlet-side gasket 14, which has a smaller diameter than upper peripheral surface 35. The above-described design of inlet-side gasket 14 is also suitable for seal seat-side gasket 16 without restrictions.

In order to make supply of fuel possible in the embodiment illustrated in FIG. 4, gasket 14 has a fuel channel 40. As an alternative, gasket 14 can be provided with a cutout 24 as shown in FIG. 1.

The present invention is not restricted to the embodiments described. In particular, a different design of actuator jacket 20, sleeve 21, bent-back zone 39 of sleeve 21, and the two gaskets 14, 16 is possible. Furthermore, the action of actuator 13 on valve needle 5 in FIGS. 1 and 2 is illustrated in a simplified manner and should not limit the present invention in this respect. In particular, the present invention is characterized by the possibility of using seal 14, 16, 20, 21 in a plurality of fuel injectors 1.

What is claimed is:

1. A fuel injector for a fuel injection system of an internal combustion engine, the fuel injector comprising:

a fuel inlet for supplying fuel;

an actuator, the actuator being one of a piezoelectric actuator and a magnetorestrictive actuator;

a seal for sealing off the actuator from the fuel, the seal including an inlet-side gasket and an actuator jacket connected to the inlet-side gasket, the inlet-side gasket being situated between the fuel inlet and the actuator, the actuator jacket being elastically deformable in a longitudinal direction;

a valve closing body cooperating with a valve seat surface to form a seal seat; and a valve needle, the valve closing body being actuable by the actuator via the valve needle, wherein:

the inlet-side gasket has at least one supply channel through which at least one electrical lead is run to the actuator.

2. The fuel injector according to claim 1, wherein:

the at least one supply channel is sealed from the fuel.

3. The fuel injector according to claim 1, wherein:

the actuator has an internal longitudinal opening, the seal further includes a tubular sleeve, the tubular sleeve traversing the longitudinal opening of the actuator and being at least partially surrounded by the actuator, the seal further includes a seal seat-side gasket connected to at least one of the actuator and the tubular sleeve, and the actuator acts upon the valve needle via the seal seat-side gasket.

* * * * *